US005655338A

United States Patent [19]

Lucas

[11] Patent Number: 5,655,338

[45] Date of Patent: Aug. 12, 1997

[54] EXPLOSION RESISTANT BUILDING STRUCTURES

[75] Inventor: Richard James Lucas, Coral Gardens, Australia

[73] Assignee: Blazley Designs Pty Ltd., Queensland, Australia

[21] Appl. No.: 481,521

[22] PCT Filed: Aug. 18, 1994

[86] PCT No.: PCT/AU94/00484

§ 371 Date: Jun. 15, 1995

§ 102(e) Date: Jun. 15, 1995

[87] PCT Pub. No.: WO95/05513

PCT Pub. Date: Feb. 23, 1995

[30] Foreign Application Priority Data

Aug. 19, 1993 [AU] Australia ..... PM0674

[51] Int. Cl.[6] ..... E02D 29/00; E04H 9/12; E04B 1/32

[52] U.S. Cl. ..... 52/169.6; 52/86; 52/88; 109/15

[58] Field of Search ..... 52/169.6, 86, 88; 109/15, 49.5, 82–84

[56] References Cited

U.S. PATENT DOCUMENTS

| | | | |
|---|---|---|---|
| 3,276,171 | 10/1966 | Brown | 52/86 |
| 3,832,958 | 9/1974 | Hiorth . | |
| 3,902,288 | 9/1975 | Knudson | 52/86 |
| 4,085,555 | 4/1978 | Mann . | |
| 4,094,110 | 6/1978 | Dickens et al. | 52/86 X |
| 4,759,159 | 7/1988 | Blazley | 52/86 |
| 4,896,466 | 1/1990 | Blazley | 52/86 X |
| 5,084,244 | 1/1992 | Barbier | 52/169.6 |
| 5,393,173 | 2/1995 | Morello | 52/86 X |

FOREIGN PATENT DOCUMENTS

| | | |
|---|---|---|
| 116759 | 4/1983 | Australia . |
| 518742 | 3/1940 | United Kingdom . |
| 522152 | 6/1940 | United Kingdom . |
| 526019 | 9/1940 | United Kingdom . |

OTHER PUBLICATIONS

Armco Barracks for Every Service Condition The Armco International Corp. Middleton, Ohio, USA 19 pages 1942.

*Primary Examiner*—Carl D. Friedman
*Assistant Examiner*—Robert J. Canfield
*Attorney, Agent, or Firm*—DeLio & Peterson

[57] ABSTRACT

An explosion resistant structure comprises arcuate interlocking cold roll formed profiled steel panels (59) over which an outer (51) of steel reinforced concrete is formed. The outer concrete skin (51) is formed integrally with a steel reinforced concrete base (60) in turn formed integrally with a steel reinforced concrete floor. Planar front and rear walls (54, 63) are formed by planar cold roll formed profiled interlocking steel panels of a similar configuration to the arcuate roof panels and a steel reinforced concrete skin is also formed over the planar steel panels. The profiled steel panels (70) are of a substantially U-shaped cross section, the upper portions (72) of the side walls (76) being interlocked and the entire side wall portions and interlocked portions are encapsulated in the steel reinforced concrete layer to form a substantially continuous steel skin over the inner surface of the structure.

12 Claims, 7 Drawing Sheets

EXPLOSION RESISTANT BUILDING STRUCTURES

This invention relates to explosion resistant shelters for munitions storage, bomb shelters for military personnel and equipment storage including aircraft.

Until now, explosion resistant shelters have generally comprised heavily reinforced concrete structures with upright walls and a flat roof or arched reinforced concrete with upright end walls.

Although a structure having an arched roof should provide a greater degree of structural integrity in resisting the forces of nearby explosions, rectangular box-like reinforced concrete shelters are more commonly used as they are less expensive to construct.

A major difficulty in the construction of arched reinforced concrete structures is the time and cost in erecting a support framework and the arched formwork required to support the steel reinforcing mesh and to support the mass of concrete subsequently poured thereon. After pouring the concrete in several stages, the structure must then be allowed to cure for a substantial period of time before the supporting framework and formwork can be removed. As the framework and formwork must be removed from within the structure it is not possible to employ cranes which may have been used initially to erect the framework and formwork.

One prior art proposal comprised a series of arcuate corrugated panels pressed or rolled from heavy steel plating. These panels were able to be erected by bolting together adjacent panels along longitudinal edges and across transverse edges through aligned apertures in the panels to form an arcuate structure.

Although the arcuate structure so formed was self supporting when completed, a support framework or scaffolding was necessary in the erection of the individual panels. The main disadvantage of this system as a supporting framework/formwork for cast in situ reinforced concrete structures is the very high cost of the steel panels and the cost of labour in installation thereof. It is believed that there is little difference between the cost of erecting a conventional arched concrete structure with removable framework and formwork and erecting an arched concrete structure with the heavy corrugated steel panels described above. Moreover, once the outer layer of concrete has cured, there is no contribution by the formwork to the mechanical properties of the reinforced concrete arch as in effect, the concrete layer simply rests on the corrugated steel formwork and is able to move relative thereto, at least in the direction of curvature of the arch, due to differing thermal expansion properties of the steel sheeting and the concrete mass.

Another disadvantage of prior art explosion proof shelters is the cost of providing an effective electrical earthing system to avoid static electricity discharges within the structure. Where munitions, fuel etc. are stored within such structures it is usually a requirement to line the interior of the roof/wall structure with interconnected copper strips which are electrically earthed. This structure is known as a Faraday cage.

While the prior art bolted corrugated panels should of themselves provide a Faraday cage, electrical connection between adjacent panels is ineffective when the panels are coated with a corrosion resistant paint or the like or if untreated steel panels are bolted together, corrosion therebetween diminishes electrical contact.

With traditional arched or "block house" type explosion resistant shelters there is a serious risk of internal spalling due to shock waves from nearby explosions. Due to dissipation of shock waves in the structure it is not uncommon for fragments of concrete to separate from internal wall and roof surfaces at high velocity. These high velocity projectiles cause damage to aircraft and other equipment as well as posing a great danger for personnel.

Yet another serious disadvantage of prior art structures is the difficulty in preventing ingress of moisture by seepage. Traditional concrete block houses or arched structures require an internal and/or external waterproof membrane of prevent water seepage. Similarly, the bolting of the corrugated steel panels through aligned apertures permits water seepage through the bolt holes and the relatively shallow channels of the corrugations also allows water seepage.

Probably the most serious disadvantage of prior art explosion proof structures is their ability to comply with contradictory requirements of an ability to withstand external explosion forces to protect the occupants or materials stored therein on the one hand and on the other hand, where the structure itself is used to store explosive materials, to shatter into small pieces in the event of an internal explosion such that damage to adjacent structures is minimised.

For this reason, prior art structures are generally limited by their construction features either solely to either explosives storehouses which shatter into small fragments in the event of an internal explosion or durable structures capable of withstanding external blast pressures but which cannot be used for storage of explosive materials.

The present invention aims to overcome or alleviate the disadvantages of prior art explosion resistant shelters and to provide a structure which is not only simple and inexpensive to construct but which overcome the prior art problems while permitting far greater flexibility in use as either an explosion resistant structure or an explosives storage.

The invention is based on adaptations to structures formed with light gauge building panels of the type generally described in our Australian Patent No. 583046.

According to the invention there is provided, in one aspect, an explosion resistant building structure comprising an arcuate roof having a plurality of interconnected cold roll formed steel panels, each said panel having in its longitudinal direction a generally arcuate configuration, each said panel having in its transverse cross-section, a main body portion, a pair of upright side engagement portions, the respective opposite sides of said main body portion defining a generally U-shaped transverse cross sectional shape, each said side portion including support flange means, the support flange means of one said side portion terminating in a female rib and the flange means of the other said side portion terminating in a male rib, said male rib being interlocked with the female rib of an adjacent said panel to define said arcuate roof structure, said female rib extending wholly to one side of its support flange means and away from said main body portion and said male rib extending from its support flange means in the same direction as said female rib;

a front wall and a rear wall having planar interconnected panels of substantially the same cross-sectional configuration as said arcuate roof panels;

a steel reinforced concrete skin extending over the respective surfaces of said arcuate roof and said front and rear walls; and, a layer of earth extending over said roof and said rear wall to form a mound having an earth wall thickness greater in the region of the base of said structure than at its uppermost region, whereby said adjacent support flanges and interlocked ribs of adjacent interconnected panels are completely encased in said steel reinforced concrete skin.

Suitably the free ends of adjacent arcuate panels are supported at respective opposed ends by substantially parallel rail members.

If required said rail members may be supported at spaced intervals by upright posts.

Preferably the free ends of adjacent arcuate panels and respective rail members and upright posts are encapsulated in a layer of reinforced concrete formed integrally with said steel reinforced skin.

Suitably said structure includes a reinforced concrete floor formed integrally with said layer of concrete encapsulating the free ends of adjacent panels.

If required said front wall may extend beyond the arcuate roof perimeter to form an upright barrier above the surface of the roof.

Preferably, said structure comprises an electrically coupled steel lining extending over the entire inner roof and wall surfaces.

Most preferably said electrically coupled steel lining is earthed.

In order that the invention may be more fully understood and put into practical effect, reference is now made to the accompanying drawings which illustrate preferred embodiments of the invention and wherein:

FIG. 1 shows a partially completed structure in accordance with the invention.

Figure 1:
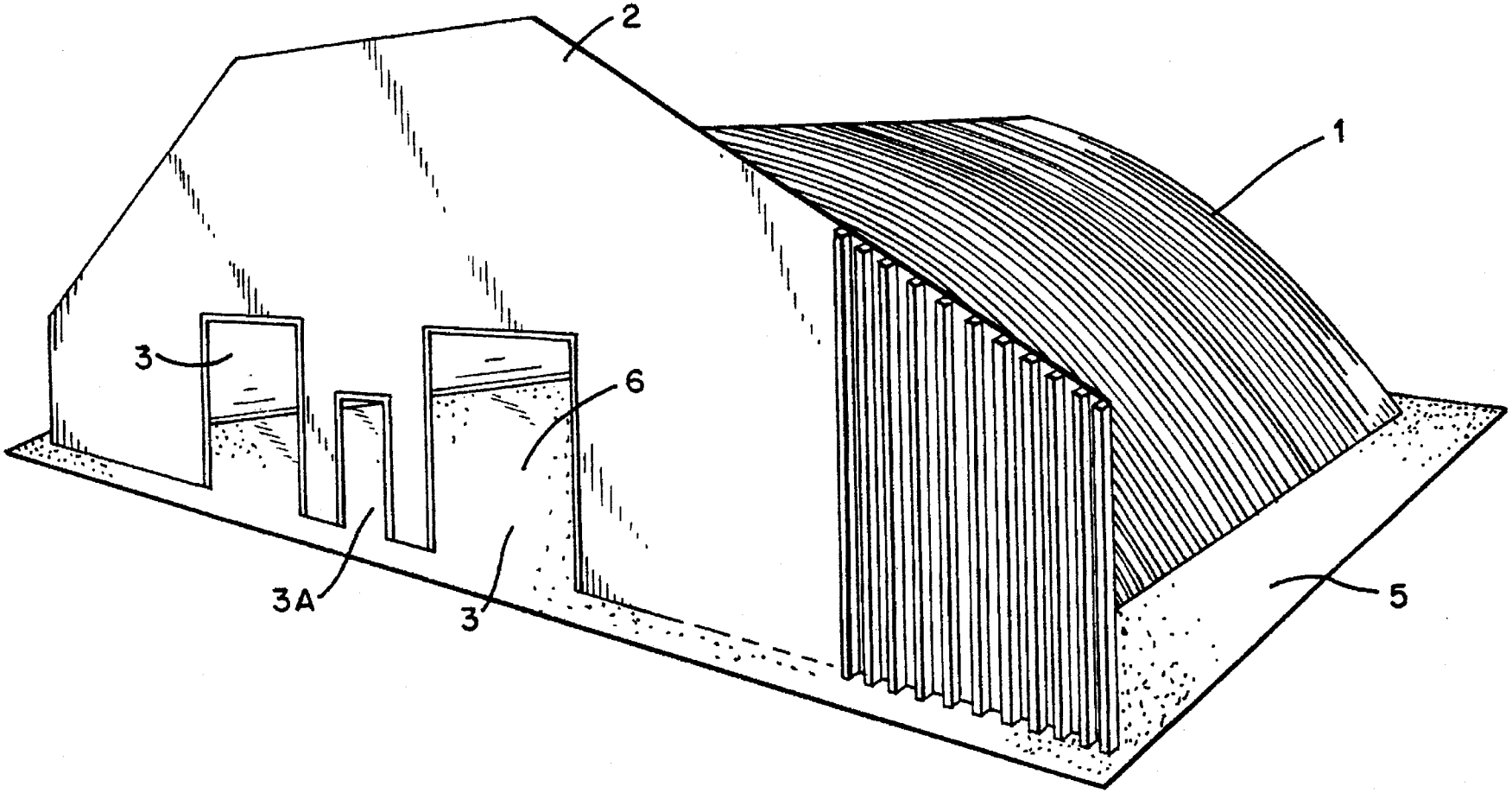
FIG. 1 illustrates a partly completed structure constructed in accordance with the present invention.
Figure 2:
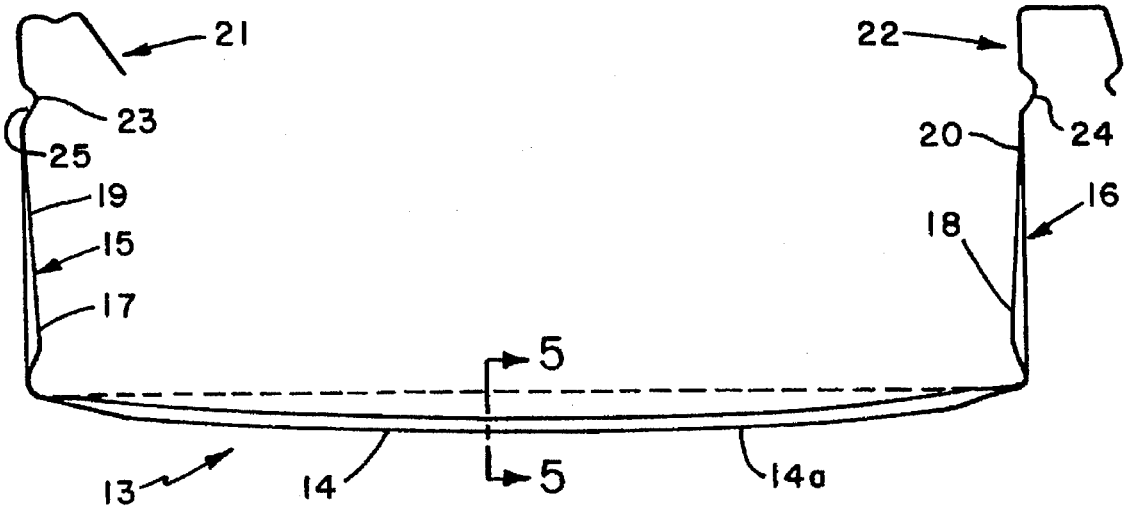
FIG. 2 illustrates in sectional view a building panel for forming the arcuate roof section of the building illustrated in FIG. 1.

In FIG. 1 the structure comprises an arched roof 1 formed by interlocking longitudinally arcuate panels of the type shown in FIG. 2.

The structure comprises a planar rear wall (not shown) having an arcuate edge abutting the edge of roof 1. The front wall 2 comprises planar interlocking panels and is formed in the shape of a truncated trapezoid with an upright portion extending above the surface of roof 1. Door apertures 3, 3A are provided in wall 2.

The free ends of the arcuate roof panels are embedded in concrete footings 5 which are formed integrally with internal concrete floor 6.

FIG. 2 shows a typical cross sectional profile of the arcuate panel employed in the invention.

The channel-like panel 13 comprises a main body portion 14 and respective upstanding side portions 15 and 16. The longitudinally arcuate configuration of the panels is achieved by transversely formed corrugations 14*a* whilst the side portions 15 and 16 at their lower ends are deformed inwardly in the form of upright corrugations shown at 17, 18 respectively to compensate for the longitudinal curvature of the body portion 14. The upright corrugations may be formed inwardly of side wall portions 15 and 16 as shown or alternatively corrugations on opposing side walls 15 and 16 may be formed inwardly and outwardly respectively to nestingly engage in adjacent interlocked panels.

Each upstanding side portion 15 and 16 includes a main support flange portion 19 and 20 respectively, each adapted to be disposed and maintained in use in a juxtaposed attitude with the flange portions 19 or 20 of an adjacent panel 13 (see FIG. 3) so as to provide the assembled roof panels 13 with the required structural rigidity. The respective flange portions 19 and 20 are surmounted by respective male and female locking ribs 21 and 22 which extend to the same sides of the respective flange portions 19 and 20 and which in use are adapted to be engaged with one another to maintain respective panels 13 in operative engagement.

The upper ends of the flange portions 19 and 20 are also provided with respective complimentary shaped locating projections 23 and 24, the projection 23 defining a concave recess 25 of complimentary shape and size to the projection 24 so that when assembled the projection 24 on the flange portion 20 locates neatly in the concave recess 25 in the flange portion 19 so that the flange portions 19 and 20 may be located in position and in a juxtaposed attitude. This engagement also serves to prevent easy detachment of adjacent roof panels 13. As shown more clearly in FIG. 4, the male rib 21 is of generally inverted U-shaped form with one side flange 26 thereof extending in a generally vertical direction and with the free side flange 26' thereof inclined outwardly from the vertical in this instance at an angle of approximately 30° thereto. The inclination of the flange 26' is achieved by means of an inward deformation 27 formed in the base of the U-shaped male rib 21. This provides for greater flexibility in the flange 26' to permit the flange 26' to be resiliently deflected inwardly to reduce the lateral dimensions of the rib 21 to facilitate its engagement with the female rib 22.

The female rib 22 is also of generally inverted U-shaped form and again one side flange 28 thereof extends generally vertically whilst the free side flange 28' thereof is slightly inclined to the vertical in this instance at an angle of approximately 15°. The flange 28' is provided adjacent its free end with an inwardly directed deformation 29 substantially aligned with the projection 24 and defining with the latter a restricted entrance into the interior of the female rib 22.

In use and when it is desired to interconnect respective panels 13, the panels 13 are positioned so that their respective longitudinal edges are adjacent to one another with the male and female ribs 21 and 22 respectively overlapping. A force is applied between the adjacent panels 13 in a direction generally parallel to the side portions 15 and 16 so that the adjacent panels 13 move relatively towards each other and so that the male rib 21 is forced through the restricted entrance of the female rib 22 and into the interior thereof. This is accomplished because the flange 26' of the male rib 21 will be resiliently deformed inwardly by virtue of the engagement of the opposite sides of the male rib 21 with the projections 24 and 29 to reduce the lateral dimensions of the rib 21 and at the same time engagement of the male rib 21 with the projections 24 and 29 of the female rib 22 will cause the flange 28' to be resiliently deflected outwardly thus increasing the lateral dimension of the rib 22 and the width of the restricted entrance thereof to permit the male rib 21 to pass into the interior of female rib 22.

When the end of the flange 26 moves beyond the projection 29, it will resiliently deflect outwardly to "snap lock" the male rib 21 and female rib 22 together. At the same time, the projection 24 will locate in the recess 25 so that the flange portions 15 and 16 will be located in a juxtaposed relationship and maintained in that relationship by virtue of the longitudinal arcuate configuration of the panels 13 and the interlocked male and female ribs 21 and 22. It will be seen from FIG. 4 that the flange 26' of the male rib 21 in its operative engaged attitude is in resilient abutment with the flange 28' of the female rib 22 thus maintaining the projection 24 in co-operative engagement with the recess 25 to lock the side portions 15 and 16 together. Furthermore, the flanges 26 and 28 are in face to face abutment and as the flange 26' is located behind the deformation 29, detachment of the male and female rib will be resisted.

In the construction of a structure according to the invention a self supporting formwork structure as shown in FIG. 1 is formed. Both planar and arcuate panels may be formed on site with a mobile roll forming apparatus.

Figure 3:
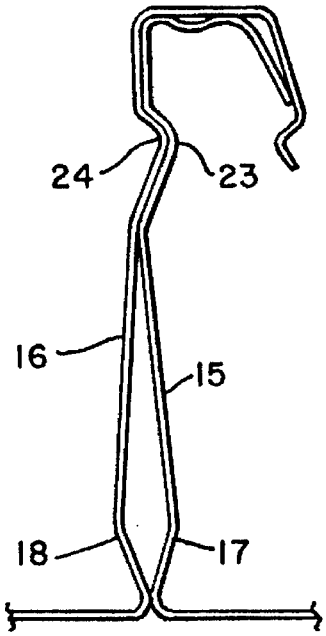
FIG. 3 illustrates the connection between adjacent building panels of the type illustrated in FIG. 2.
Figure 5:
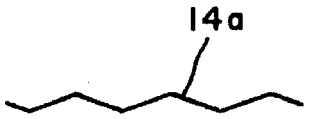
FIG. 5 is a typical cross-sectional view of the arcuate panel along line 5—5 in FIG. 2.

The arcuate roof panels are formed by forming upright corrugations in the side portions and transverse corrugations in the main portion of the panels in the manner shown in FIGS. 2, 3 and 5. The so formed roof panels are then interconnected preferably with a connection tool 35 and in the manner shown in FIG. 6. The tool 35 includes a first frame portion 36 supporting a pair of rollers 37 adapted for engagement with the upper surface of the female rib 22 and a second frame portion 38 which supports a further pair of rollers 39 which locate in use within the interior of the male rib 21. The frame portions 36 and 38 are slidably interconnected to permit the rollers 37 and 39 to move towards or away from each other whilst actuating means 40 in the form of a threaded cranked member is threadably engaged with the frame portion 38 and abutted against the frame portion 36 so that the frame portions 36 and 38 and associated rollers can be moved towards each other. Preferably the frame portion 36 includes a U-shaped handle portion 41 to permit the tool 35 to be grasped and moved along the panel ribs.

Figure 4:
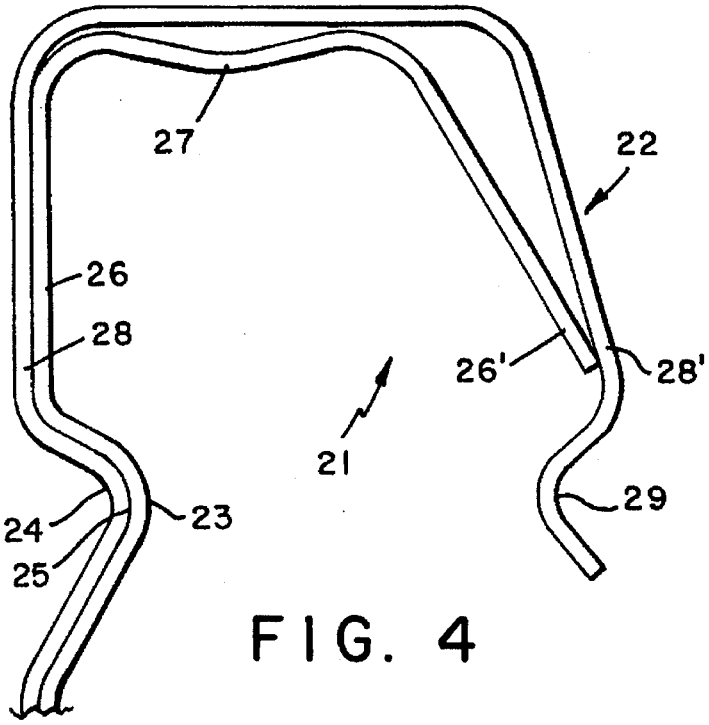
FIG. 4 is an enlarged view illustrating the "snap-lock" connection between adjacent building panels.

In use a first panel is laid on the ground and a second panel 13 laid on the first panel 13 with the respective male and female ribs in alignment. The tool 35 is located at one end of the panels and disposed relative to the ribs in the manner shown in FIG. 6. The cranked member 40 is then rotated to move the frame portions 36 and 38 and rollers 37 and 39 towards each other to force the male rib 21 into operative engagement with the female rib as shown in FIG. 4. The tool handle 41 is then grasped and the tool moved along the ribs to force the male rib 21 into the female rib 22 along the full length of the panels. This procedure may be repeated for each respective panel, however, preferably sets of three panels are interconnected on the ground as described above and then erected. The respective erected sets of panels are then interconnected again by the use of the tool 35 and in this instance a cord or rope is attached to the handle 41 and passed to the other side of the building where it is grasped so that the tool 35 may be drawn along the panel ribs and over the roof to interconnect the panel sets.

After mounting the interconnected arcuate panels on a suitable foundation structure (described later with reference to FIG. 9) the structure as shown in FIG. 1 is ready for reinforcing.

Figure 7:
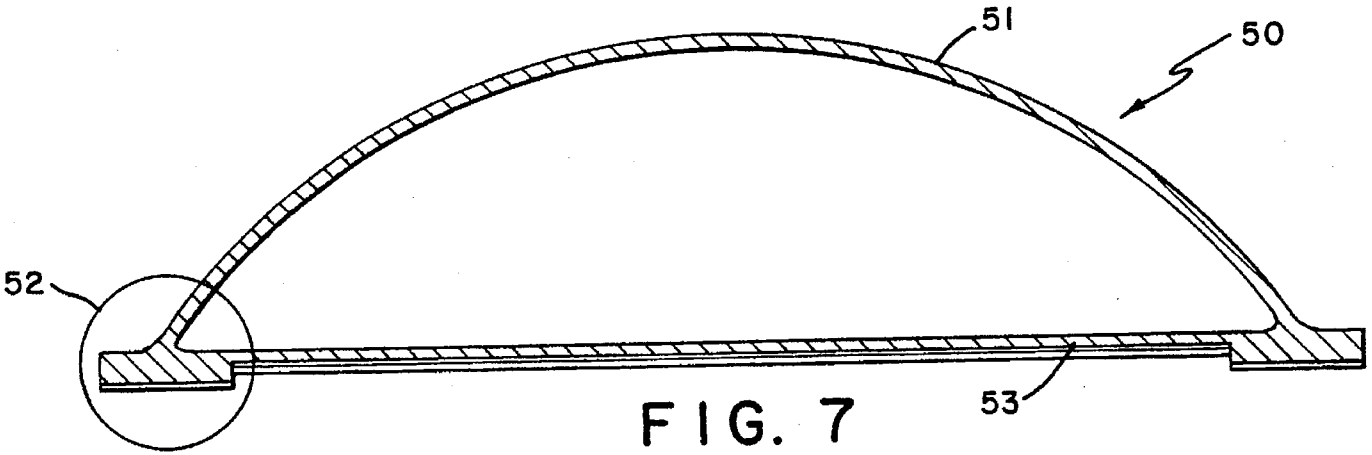
FIG. 7 shows schematically a cross sectional view of a partly completed structure in accordance with the invention.

FIG. 7 shows schematically transverse cross section of a structure 50 comprising the steel formwork structure of FIG. 1 to which a steel reinforced skin 51 has been applied. Skin 51 is formed integrally with the foundation structure 52 (encircled) which in turn is formed integrally with inner concrete floor 53.

Figure 8:
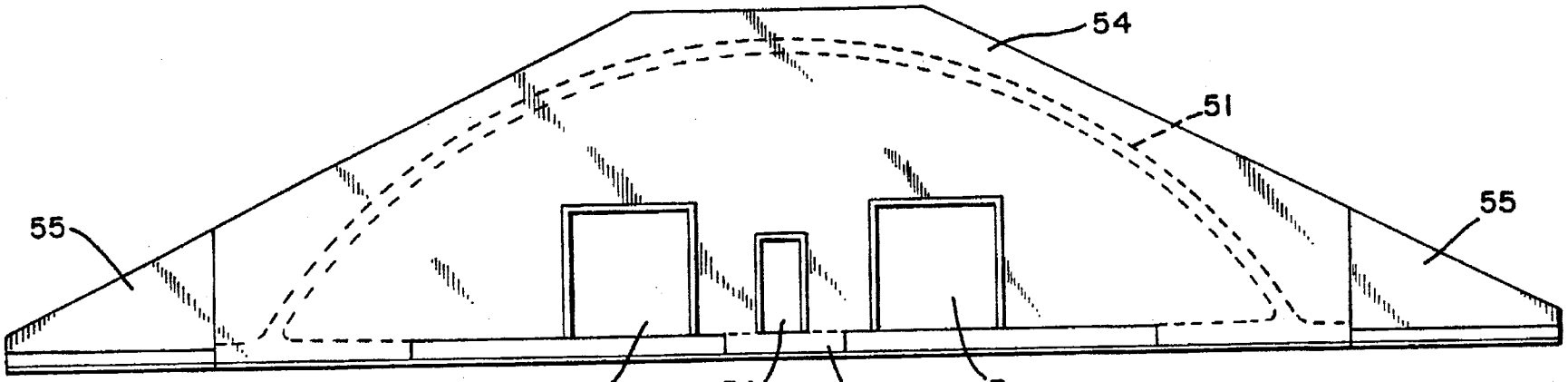
FIG. 8 shows a front elevation of the partly completed structure of FIG. 7.

FIG. 8 shows a front elevation of the structure of FIG. 1 having a steel reinforced concrete front wall 54 to which side buttresses 55 have been attached for additional strength thus forming a generally trapezoidal front wall 54. Vehicular access is provided by doorways 3 and personnel access via doorway 3*a*.

Figure 9:
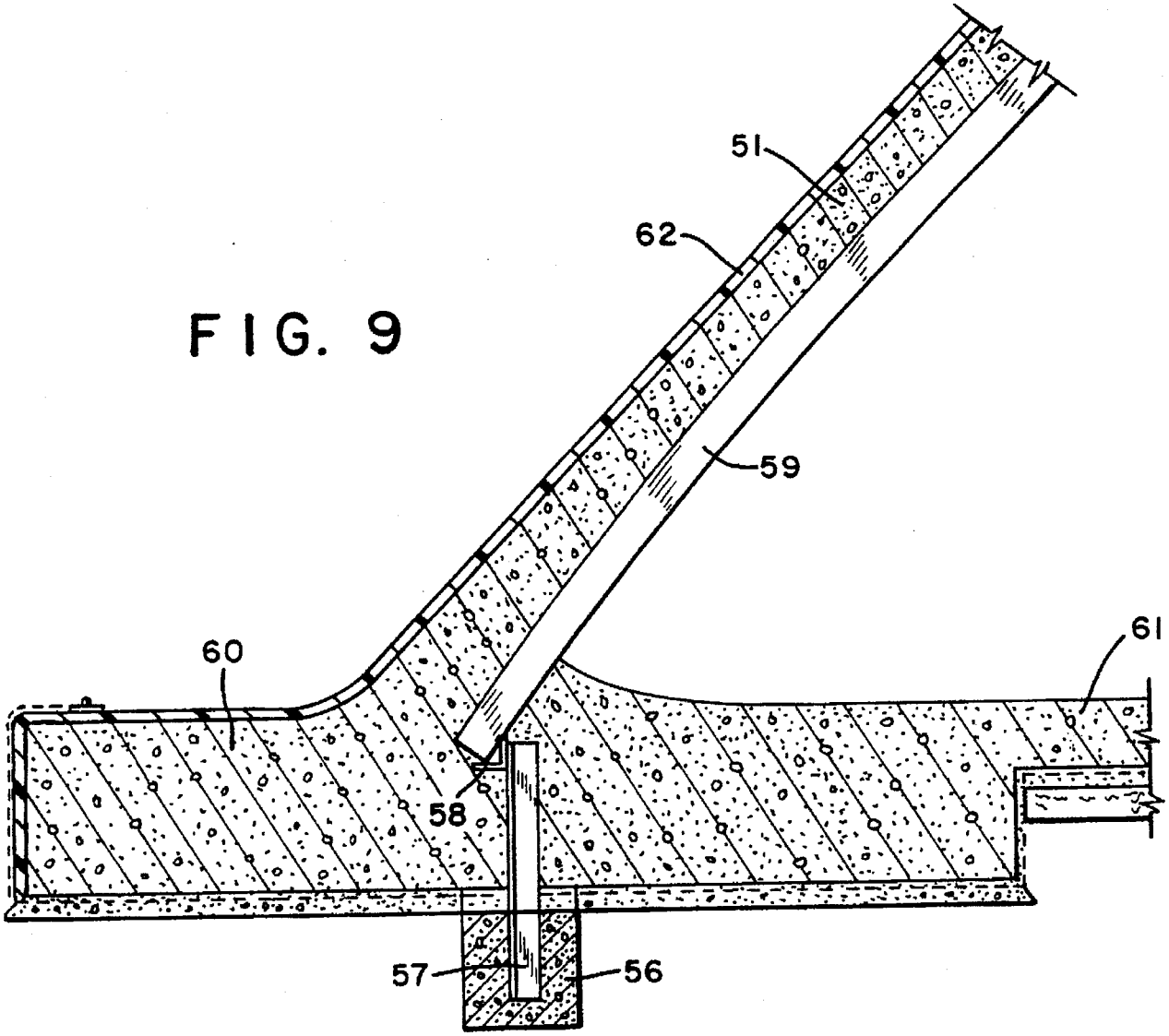
FIG. 9 shows an enlarged view of the region encircled in FIG. 7.

FIG. 9 shows an enlarged view of the area encircled in FIG. 7.

In erecting the structure, footings 56 are formed by pouring concrete into parallel trenches spaced at an appropriate distance. Spaced upright posts 57 are located in the footings 56. A support rail 58 is then connected to each row of posts 57.

As each arcuate panel 13, 59 (or group of interconnected panels) is hoisted into place by a crane, the free ends of the panels are bolted to rails 58. Adjacent panels or groups of panels are interconnected by means of the joining tool shown in FIG. 6.

When all roof panels are mounted, the front and rear walls are formed from planar lengths of profiled panel section having a similar configuration to that shown in FIG. 2 except that corrugations 14*a*, 17 and 18 are not formed. The front and rear walls are then attached to the arcuate roof structure.

Reinforcing steel in the form of rods, mesh or a combination thereof are then positioned over the arcuate roof structure and concrete having a strength of say 30–50 Mpa is then sprayed over the surface to a generally uniform depth of between 200–300 mm, thus totally encapsulating the upstanding side walls 15, 16 of the panels.

The concrete skin 51 extends down to the base of the panels 59 to create an integrally formed base 60 which encapsulates the free ends of panels 59, posts 57 and rails 58. Base 60 is also integrally formed with the inner concrete floor 61 of the structure.

If required a waterproof rubber or plastics membrane 62 may be applied over the surface of skin 51 to assist in water proofing skin 51. It is not believed that water proofing is necessary however given the deep ribbed structure of panels 59 and the inherently waterproof interlocking ribs.

Upright steel reinforcing is then positioned against the front and rear walls which are shuttered with removable formwork. After pouring the front and rear walls with concrete, the formwork is removed and finally formwork is erected to enable pouring of concrete buttresses 55.

Figure 10:
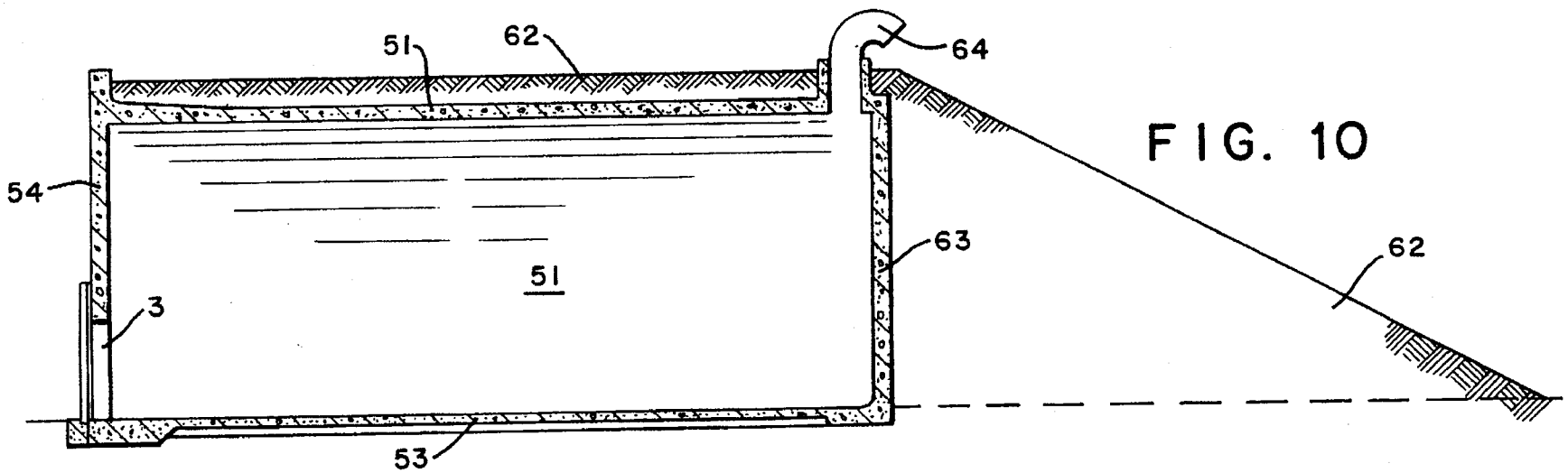
FIG. 10 shows schematically a side elevational cross-sectional view of a completed structure.

FIG. 10 shows a cross-sectional profile of a completed blast proof structure.

After the concrete skin 51 has cured a layer of earth 62 is built up around the sides and the rear wall 63 of the structure. The structure is eventually buried in an earth mound-having a cross sectional shape similar to the shape of front wall 54. The layer of earth over the top of the structure is at its thinnest at about 600 mm.

If required, a ventilation shaft 64 may be formed in the structure and sliding blast proof doors (not shown) are then attached to the structure.

Figure 12:
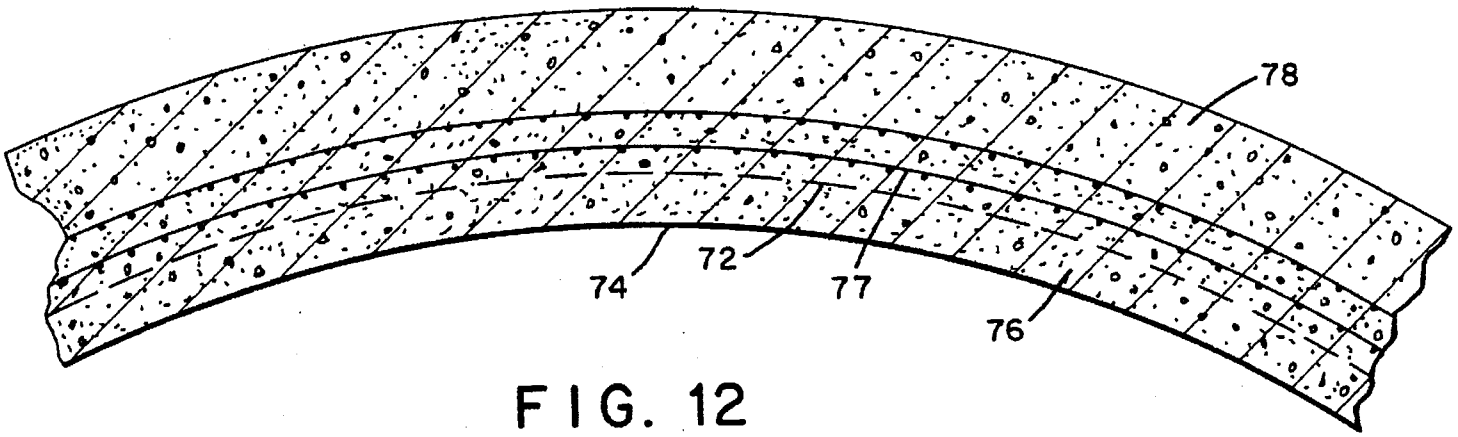
FIG. 12 illustrates a part cross sectional view taken along line 12—12 in FIG. 11.
Figure 11:
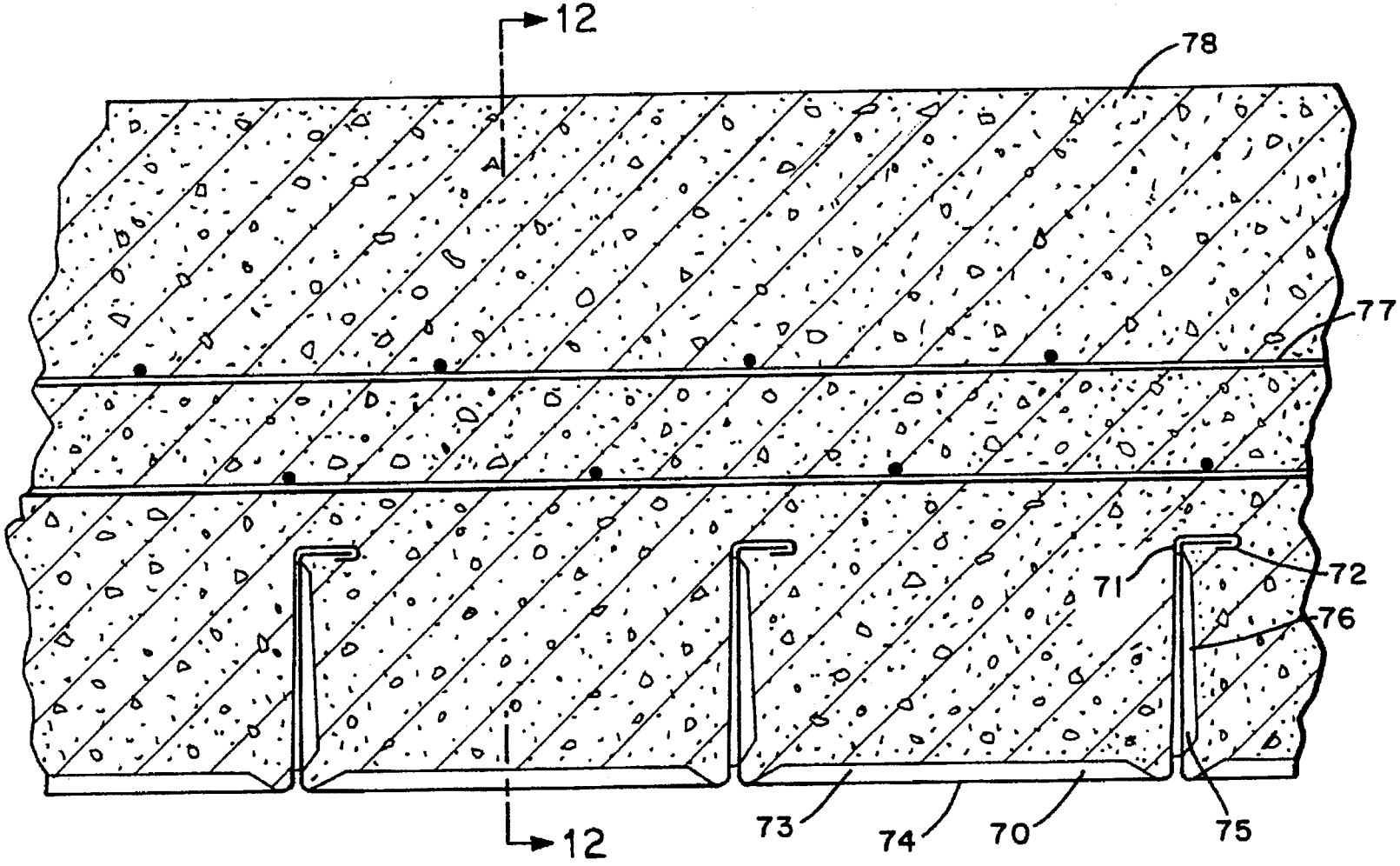
FIG. 11 shows a partial cross sectional views of an alternative embodiment of the invention.

FIGS. 11 and 12 show schematically an alternative embodiment of the invention and otherwise serve to illustrate the mechanical properties thereof.

FIG. 11 illustrates schematically an enlarged part cross sectional view of the reinforced roof structure when viewed in the direction of curvature of the arch.

FIG. 12 illustrates a part cross sectional view of the structure of FIG. 11 through the section A—A.

The structure comprises roll formed arched steel panels 70 having a U-shaped cross section and interlocked at adjacent upper edges 71 by simple swaged interlocking flanges 72.

Like the panels of FIG. 2, the U-shaped panels include transverse corrugations 73 in the floor 74 of the panels and nesting upright corrugations 75 in the side walls 76.

Reinforcing bars or mesh 77 are positioned above the steel panels and a layer of concrete 78 encapsulates the reinforcing bars/mesh as well as the upright side walls 72 and the transversely oriented interengaged flanges 72.

Figure 6:
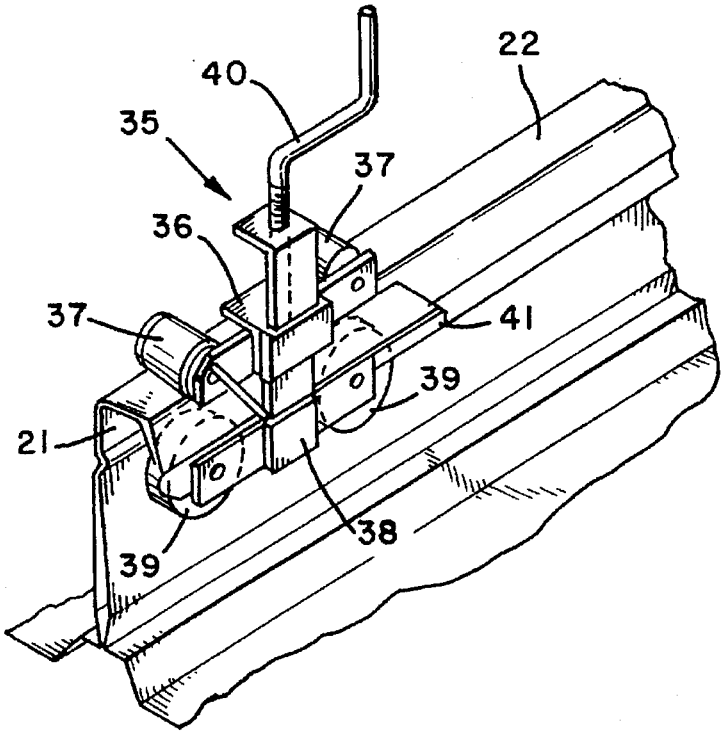
FIG. 6 illustrates in perspective view, a tool for interconnection of building panels.

The interengaged flanges 72 may be locked together by a simple swaged joint as shown by a travelling swaging tool similar to that of FIG. 6 and, if required the flanges 72 may be secured by spaced fasteners such as bolts, rivets or the like (not shown). Alternatively, the interlocking engagement of flanges 72 may be achieved by a double swaging process.

The surprising and otherwise mutually competing requirements of a structure able to withstand substantial external blast pressures, yet have the capacity to shatter into small pieces arise from the unique combination of the arched steel structure having panels of deep U-shaped cross section with an arched reinforced concrete outer skin.

In considering the effect of external blast forces on the structure, the steel reinforced concrete structure may be considered as a continuous arcuate beam. Encased within the arcuate beam is a steel reinforcing in the form of rods and or mesh 77 and such a simple reinforced concrete beam structure, apart from the contribution of the steel panelling, would behave in an entirely predictable manner when subjected to internal or external blast loads. Normally in such a situation where say corrugated sheet steel is employed as formwork for the concrete structure, no contribution of the steel formwork is taken into account in load calculations as there is no interworking relationship between the formwork and the cured beam.

In the case of the present invention however, the arched steel structure, while initially acting merely as formwork during the concrete pouring stage, makes a significant contribution to the performance of the arched concrete beam in compression as a result of an externally applied load.

When such an arched structure is subjected to a compressive load great enough to cause an inward deformation of the reinforced concrete wall, the outer surface of the beam goes into compression while the inner surface goes into tension. While theoretically it would be desirable to have the steel reinforcing as close as possible to the surface of the beam undergoing tension, there are practical limitations to the spacing of steel reinforcing from the tensioned surface.

Accordingly when a steel reinforced concrete beam undergoes a deformation from an applied load, the tensile resistance of the steel reinforcing occurs inwardly of the tensioned beam surface with the result that the tensioned surface of the concrete beam will crack and spall thus reducing the integrity of the beam.

The arcuate trough-like panels employed in the invention are typically about 300 mm wide and the side walls 76 are typically about 125 mm deep. The sheet metal from which the panels may be roll formed may be from 0.5 mm to 2 mm or even greater depending upon strength requirements. Typically however the sheet metal is about 1 mm in thickness.

As shown in FIG. 11 the interengaged arcuate panels 70 effectively form a metal skin at the inner surface of the concrete beam. This "skin" provides not only steel reinforcing at the concrete surface undergoing tension, it also provides a barrier to restrain spalling.

The paired upright walls 76 of the panels 70 act as substantial webs separating the interconnecting flanges 72 and the outer skin. For this reason, the interconnected panels 70 act as steel I beams in the region between the reinforcing mesh/or rod structure 77 and the inner surface of the beam subjected to tensile forces.

When unsupported, the steel "I beams" formed by the interlocked panels readily would be subjected to a buckling mode of failure both in the interconnected upper "flange" 72 and the "web" formed by adjacent walls 76. However, as these "I beams" are fully encased in a mass of concrete the buckling mode of failure is resisted by the substantial compressive strength of the concrete.

Moreover relative movement in the direction of arcuate curvature between the concrete mass and the interlocked panels is resisted by the corrugated surfaces of floors 74 and walls 76 of adjacent panels.

It can be seen therefore that unlike simple corrugated sheet steel formwork, the arcuate panels of the composite structure make a substantial contribution to the load bearing capacity of the finished structure when subjected to externally applied blast loads.

In order to evaluate the effectiveness of structures according to the invention, field trials were conducted by the Australian Department of Defence with assistance from the Explosives Ordinance Division of the Materials Research Laboratory with the Waterways Experiment Station and the U.S. Department of Army Corps of Engineering providing considerable additional instrumentation support.

The aim of the trial was to obtain data on the characteristics of a 23 meter span structure in accordance with the invention in a receptor role and gain fragmentation information of a 13 meter span structure according to the invention in a donor role.

The trial was conducted using British Explosives Storehouse Test Criteria (ESTC) and employed 75,000 kg of explosives (75 tonnes Nett Explosive Quantity (NEQ)) packed into the donor structure.

The donor structure was positioned 21 meters to one side of the receptor structure and both the donor and receptor structure employed 300 mm×125 mm×1 mm thick steel panels over which a layer of steel reinforced 32 MPa concrete was placed with a thickness varying from 250 mm at the centre of the arch to 350 mm at the side supports. A layer of soil having a depth of 600 mm at the crown and a soil slope of 1:2 was then placed over both structures.

Upon detonation, the donor structure was completely demolished with only small fragments of concrete forming high velocity low momentum missiles impacting against the receptor structure resulting only in cosmetic impact damage to the exposed wall surfaces of the receptor structure.

The receptor structure, apart from undergoing some elastic deformation was substantially undamaged by blast pressures apart from some minor hair line cracking in regions of the concrete layer tested by core sampling.

It is believed that the extent of fragmentation of the donor structure was in fact assisted by the steel panelling whereas the steel panelling provided a substantial contribution to the integrity of the receptor structure. Whereas the steel panelling under compression from external loads reinforces the concrete arch, it is believed to operate in reverse under internal loading which places the inner surface of the shell under tension.

With the side walls of the steel panelling extending 125 mm into the body of the concrete shell at 300 mm spacings on the inner surface, these provide regularly spaced weaknesses or "crack" points which encourage fragmentation of the concrete shell into small fragments.

A post detonation site inspection revealed only very small particles of the steel arch lining suggesting that under the pressures applied, the mechanical interengagement of the thin steel lining with the concrete caused a "shredding" effect thus minimising the contribution to the integrity of the structure.

A particular advantage of explosion resistant structures according to the invention is that in comparison with prior art structures for munitions or other explosives structures, is that in a facility comprising a plurality of arch structures, each structure permits a maximised storage capacity with minimised spacing between adjacent structures. Accordingly, this minimises the costs in land acquisition, infrastructure in the form of roadways, services distribution and the like as well as minimising personnel movement about the facility.

Moreover, the complete inner lining of steel provides a completely electrically grounded inner surface to the structure without the need for separate electrical grounding strips or mesh and at the same time prevents the separation of high velocity fragments from inner wall surfaces due to spalling under the influence of explosive shock waves. The steel lining of the wall and roof surfaces provides an electrically coupled contiguous conductive shell within the structure to prevent electrostatic discharges within the buildings and also to act as a radiation shield. It is believed that the metal/metal coupling at the support rails at each end of the panels provides a sufficient grounding to dissipate electrical charge but additional earth straps and grounding posts may be provided if required.

The other advantage associated with the invention is that it may be completely fabricated on site without the inconvenience and cost of having to transport large prefabricated panels over long distances.

I claim:

1. An explosion resistant building structure comprising:

an arcuate roof having a plurality of interconnected cold roll formed steel panels, each said panel having in its longitudinal direction a generally arcuate configuration, each said panel having in its transverse cross section, a main body portion, and a pair of upright side engagement portions at the respective opposite sides of said main body portion defining a generally U-shaped transverse cross sectional shape, each said side portion including support flange means, the support flange means of one of said side portion terminating in a female rib and the support flange means of the other side portion terminating in a male rib, said male rib being interlocked with the female rib of an adjacent said panel to define said arcuate roof, said female rib extending wholly to one side of its support flange means and away from said main body portion and said male rib extending from its support flange means in the same direction as the female rib;

a front wall and rear wall having interconnected panels of substantially the same cross sectional configuration as said arcuate roof panels;

a steel reinforced concrete skin extending over the respective surfaces of said arcuate roof and said front and rear walls; and, a layer of earth extending over said roof and said rear wall to form a mound having an earth wall thickness greater in the region of the base of said structure than at its uppermost region, whereby said adjacent support flanges and interlocked ribs of adjacent interconnected panels are completely encased in said steel reinforced concrete skin.

2. A structure as claimed in claim 1 wherein the interconnection between the male and female ribs is a single swaged joint.

3. A structure as claimed in claim 1 wherein the interconnection between the male and female ribs is a double swaged joint.

4. A structure as claimed in claim 1 wherein the female rib has a generally inverted U-shape form in transverse cross section and has a first leg comprising an extension of said support flange means of said female rib and a second leg spaced from said first leg, said second leg having at its free end an inwardly directed first deformation and there being provided a second deformation in the region of the junction between said first leg and said supporting flange means arranged substantially opposite and extending inwardly towards said first deformation, said male rib being of generally inverted U-shape form in transverse cross section and received within the female rib of an adjacent said panel, said male rib including a first leg comprising an extension of said support flange means of said male rib, and a second leg spaced from said first leg and inclined outwardly away from said first leg and there being provided a recess in the region of the junction between said first leg and said support flange means of said male rib, said recess being complementary to said second deformation and nestingly receiving said second deformation of said female rib of said adjacent panel, said first leg of said male rib being juxtaposed with said first leg of a female rib of said adjacent panel and said second leg of said male rib resiliently engaging said second leg of said adjacent panel female rib inwardly of said first deformation therein.

5. A structure as claimed in claim 1 wherein said opposite sides of each said panel include upright corrugations, the corrugations of one side portion being directed in an inward direction and the corrugations of an opposite side portion being directed in an outward direction whereby the corrugations of one side portion nestingly engage with the corrugations of a side portion of an adjacent panel when said respective male and female ribs are interlocked.

6. A structure as claimed in claim 1 wherein the free ends of the arcuate panels are supported at respective opposed ends by substantially parallel rail members.

7. A structure as claimed in claim 6 wherein the rail members are supported on upright posts.

8. A structure as claimed in claim 7 wherein the free ends of adjacent arcuate panels and respective rail members and upright posts are encapsulated in a layer of steel reinforced concrete formed integrally with the steel reinforced concrete skin extending over said arcuate panels.

9. A structure as claimed in claim 8 including a steel reinforced concrete floor formed integrally with the steel reinforced concrete skin extending over said arcuate panels.

10. A structure as claimed in claim 9 wherein the steel reinforced concrete skin extending over the substantially planar front and rear walls is formed integrally with the steel reinforced concrete floor and the steel reinforced concrete skin extending over the arcuate panels.

11. A structure as claimed in claim 1 wherein the interconnected cold roll formed steel panels form an electrically coupled steel lining extending over the entire inner roof and wall surfaces.

12. A structure as claimed in claim 11 wherein the electrically coupled steel lining is grounded to form a Faraday cage.

* * * * *